United States Patent [19]

Koel et al.

[11] 4,175,010

[45] Nov. 20, 1979

[54] METHOD OF REINFORCING A CONDUCTIVE BASE PATTERN BY ELECTROPLATING AND DEVICE OBTAINED BY MEANS OF THE METHOD

[75] Inventors: Gerrit J. Koel; Jan Gerkema, both of Eindhoven, Netherlands

[73] Assignee: U.S. Philips Corporation, New York, N.Y.

[21] Appl. No.: 895,932

[22] Filed: Apr. 13, 1978

[30] Foreign Application Priority Data

Apr. 18, 1977 [NL] Netherlands ..... 7704186

[51] Int. Cl.[2] ..... C25D 5/02; C25D 7/12

[52] U.S. Cl. ..... 204/15; 204/38 B; 204/192 SP

[58] Field of Search ..... 204/15, 192 R, 192 SP, 204/38 B

[56] References Cited

U.S. PATENT DOCUMENTS

| | | | |
|---|---|---|---|
| 3,737,380 | 6/1973 | Bachmeier | 204/15 |
| 3,776,820 | 12/1973 | Johnson et al. | 204/15 |
| 3,935,083 | 1/1976 | Tomozawa | 204/15 |

FOREIGN PATENT DOCUMENTS

| | | | |
|---|---|---|---|
| 1293574 | 10/1972 | United Kingdom | 204/15 |

*Primary Examiner*—T. M. Tufariello

*Attorney, Agent, or Firm*—Norman N. Spain

[57] ABSTRACT

A method of manufacturing a device in which a conductive base pattern is formed on a substrate and is reinforced by electroplating so as to obtain a conductor pattern, characterized in that at least a surface layer of the substrate consists of an electrically insulating material on which an auxiliary layer is provided having a sheet resistance between $10^{12}$ and $10^{17}$ ohms per square, after which the base pattern is formed on the last-mentioned layer.

5 Claims, 1 Drawing Figure

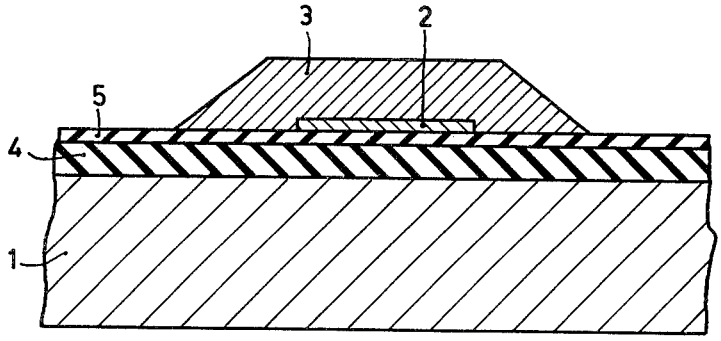
3
2
5
4
1

METHOD OF REINFORCING A CONDUCTIVE BASE PATTERN BY ELECTROPLATING AND DEVICE OBTAINED BY MEANS OF THE METHOD

The invention relates to a method of manufacturing a device in which a conductive base pattern is formed on a substrate and is reinforced by electroplating so as to obtain a conductor pattern, and to a device manufactured by means of the method.

Devices manufactured in this manner are, for example, semiconductor devices such as transistors, integrated circuits and thin-film magnetic heads.

In the method mentioned in the preamble the base pattern may grow to form a conductor pattern having a circular profile at its edges.

Such a profile is not suitable for many applications. For example, when an insulating layer which is not too thick is to be provided on the conductor pattern, a completely sealed coating is often not possible, which gives rise, for example, to shortcircuits when another conductor pattern is to be provided on the insulating layer.

One of the objects of the invention is to avoid the described problems at least to considerably extent while allowing the reinforcement of the base pattern by electroplating.

The invention is based inter alia on the recognition that, when a suitable subtratum is used for the base pattern, an edge profile having a uniform slope can be obtained.

According to the invention, the method mentioned in the preamble is therefore characterized in that at least a surface layer of the substrate consists of an electrically insulating material on which an auxiliary layer is provided having a sheet resistance of between $10^{12}$ and $10^{17}$ ohms per square, after which the base pattern is formed on the last-mentioned layer.

It has been found that due to the presence of the auxiliary layer the rate of reinforcing by electroplating obtains an extra horizontal component the value of which depends on the value of the sheet resistance.

It has been found that at a rate which depends on the sheet resistance value the auxiliary layer assumes a potential which is sufficient for electroplating material. Once a continuous layer has been formed, it will grow further at the same vertical rate as the remaining part of the conductor pattern.

With the range of sheet resistance values of the invention, edge profiles can be obtained having slopes which are substantially constant throughout there cross-sections and the value of which depends on the sheet resistance of the auxiliary layer.

It has been found that insulating layers free of interruptions can be provided over the conductor patterns obtained by the method according to the invention.

The method according to the invention is preferably used to obtain multilayer wiring, in which the conductor pattern is provided with an insulating layer on which a second conductor pattern is provided. The second conductor pattern can be obtained in the same manner as the first conductor pattern, namely by using an auxiliary layer.

It is often useful that after reinforcing the base pattern by electroplating the auxiliary layer, in as far as it is not covered by the conductor pattern, is removed.

The formation of the auxiliary layer is often particularly simple when the auxiliary layer is obtained by the sputtering in an oxygen atmosphere of the same material as was used for the base pattern. In this case an oxide of this material is obtained having a sheet resistance in the above-mentioned range.

The invention furthermore relates to a device manufactured by means of the method according to the invention.

The invention will now be described in greater detail with reference to an example and the accompanying drawing.

In the drawing, the FIGURE is a diagrammatic cross-sectional view of a part of a device in a stage of manufacture by means of the method according to the invention.

The following example describes the manufacture of a device in which a conductive base pattern 2 is formed on a substrate (1, 4) and is reinforced by electroplating so as to obtain a conductor pattern 3.

According to the invention, at least a surface layer 4 of the substrate 1 consists of electrically insulating material on which an auxiliary layer 5 is provided having a sheet resistance between $10^{12}$ and $10^{17}$ ohms per square, after which the base pattern 2 is formed on the layer 5.

In manufacturing thin-film magnetic heads, for example, a silicon substrate 1 is into initially provided with an insulating silicon oxide layer 4 in any usual manner.

Layer 5 is thin formed on layer 4 by sputtering nickel iron in an oxygen atmosphere at a pressure of 4 to $7.10^{-4}$ Torr. It has been found that the ultimate result is only slightly dependent on the actual value of the pressure employed in this range.

With a sputtering time of 2 minutes and a power density of 0.6 W/cm$^2$, a thickness of $\sim$0.01 $\mu$m is obtained. The sheet resistance of layer 5 is $\sim 10^{14}$ ohm per square.

A 0.1 $\mu$m thick layer of nickel iron 2 is then formed on the layer 5 by sputtering a layer of nickel iron in an argon atmosphere at a pressure of approximately $10^{-2}$ Torr, after which the base pattern 2 is formed selectively with respect to the auxiliary layer 5 in said nickel iron layer by means of any of the usual photoetching treatments.

The base pattern 2 is reinforced by electroplating to form the conductor pattern 3 by a method in the whole assembly of substrate 1 and the layers thereon 2, 4 and 5 is immersed in a bath containing per liter of water 130 g of nickel sulphate ($NiSO_4.6H_2O$), 28 g of ammonium ferrosulphate ($Fe(NH_4)(SO_4)_2.6H_2O$), 3 g of saccharin, 40 g of boric acid and 0.4 g of sodium lauryl sulphate.

The bath is kept at 35° C. and the assembly is given a potential with respect to a platinum electrode. A current of 50 mA per cm$^2$ of surface area of the assembly is passed through the bath for one minute and a 1.1. $\mu$m thick conductor pattern is obtained.

In the pressure range used for providing the auxiliary layer, the acute angle which the pattern 3 makes with the layer 5 is 13° to 15°.

The said angle can be influenced, for example, by rotation about an axis normal to the base pattern 2 during the electroplating process.

In the example described, the body shown in the FIGURE was placed vertically in an electroplating bath. The angle obtained when it was placed horizontally was, for example, 28°.

After the electroplating process the conductor pattern 3 can be provided, for example, with successively an insulating silicon oxide layer, a copper layer, an insulating silicon oxide layer a nickel iron layer and an insulating silicon oxide layer (not shown) so as to obtain a body from which thin-film magnetic heads each having a nickel iron core can be manufactured.

Each conductive layer can be manufactured in the form of a desired pattern by means of the method according to the invention. Upon forming a copper pattern, an auxiliary layer may also be used, which is obtained by sputtering permalloy in an oxygen atmosphere, and a base pattern of permalloy.

If desired, after the electroplating process, the auxiliary layer can be removed selectively with respect to the conductor pattern.

The invention is not restricted to the example described.

Other combinations of materials for conductor pattern and auxiliary layer may be chosen and, for example, conductor patterns of gold or silver may be formed on an auxiliary layer of oxidized nickel iron.

The method according to the invention may alternatively be used in manufacturing semiconductor devices.

What is claimed is:

1. In a method of manufacturing a device in which an electrically conductive base pattern is formed on a substrate, the surface of which substrate consists of an electrically insulating material, and which conductive base pattern is electroplated so as to form a electrically conductive pattern thereon, the improvement wherein an auxiliary layer having a sheet resistance of between $10^{12}$ and $10^{17}$ ohms per square is provided on the electrically insulating surface of said substrate and the electrically conductive base pattern is then formed on said auxiliary layer.

2. A method as claimed in claim 1, characterized in that the conductor pattern is provided with an insulating layer on which a second conductor pattern is provided.

3. A method of claim 1 wherein the portions of the auxiliary layer not covered by the conductor pattern are removed after the base pattern is electroplated.

4. A method of claim 1 wherein the auxiliary layer is obtained by the sputtering in an oxygen atmosphere, of the same material as is employed to form the electrically conductive base pattern.

5. A device manufactured by means of the method of claim 1.

* * * * *